US007574289B2

(12) United States Patent
Moffett et al.

(10) Patent No.: US 7,574,289 B2
(45) Date of Patent: Aug. 11, 2009

(54) RAIL WHEEL SERVICING MANAGEMENT

(75) Inventors: Jeffrey Paul Moffett, Wattsburg, PA (US); Larry Moneymaker, Erie, PA (US)

(73) Assignee: Geenral Electric Company, Schenectady, NY (US)

( * ) Notice: Subject to any disclaimer, the term of this patent is extended or adjusted under 35 U.S.C. 154(b) by 534 days.

(21) Appl. No.: 11/392,374

(22) Filed: Mar. 29, 2006

(65) Prior Publication Data

US 2007/0233333 A1 Oct. 4, 2007

(51) Int. Cl.
*G01N 24/00* (2006.01)

(52) U.S. Cl. ..... 701/19; 82/11

(58) Field of Classification Search ..... 701/19; 82/1.11, 104, 11, 105; 250/559.19, 559.2, 250/559.22; 356/635
See application file for complete search history.

(56) References Cited

U.S. PATENT DOCUMENTS

| | | | | |
|---|---|---|---|---|
| 3,347,117 | A | 10/1967 | Luzina et al. | |
| 3,518,914 | A | 7/1970 | Dombrowski et al. | |
| 3,938,254 | A | 2/1976 | Miller, Jr. | |
| 4,134,314 | A * | 1/1979 | Luzina | 82/1.11 |
| 4,798,963 | A * | 1/1989 | Wittkopp et al. | 250/559.22 |
| 4,904,939 | A | 2/1990 | Mian | |
| 4,932,784 | A * | 6/1990 | Danneskiold-Samsoe | 356/602 |
| 5,351,411 | A | 10/1994 | Gronskov | |
| 6,416,020 | B1 | 7/2002 | Bronskov | |
| 6,909,514 | B2 * | 6/2005 | Nayebi | 356/601 |
| 2005/0259273 | A1 | 11/2005 | Mian et al. | |

FOREIGN PATENT DOCUMENTS

| | | | |
|---|---|---|---|
| DE | 10 2004 045850 | A1 | 3/2006 |
| EP | 0555169 | A1 | 8/1993 |

* cited by examiner

*Primary Examiner*—Dalena Tran
(74) *Attorney, Agent, or Firm*—John Kramer, Esq.; Enrique J. Mora, Esq.; Beusse Wolter Sanks Mora & Maire, P.A.

(57) ABSTRACT

A system (10) for providing rail wheel truing recommendations based on rail wheel measurements includes an input device (11) for inputting information into the system. The system also includes a processor (12) receiving measured rail wheel dimensions (14) for respective wheels of a rail vehicle from the input device and a memory (16) in communication with the processor for storing a rule base (18) comprising rules for performing rail wheel truing. The system further includes logic (20) executable by the processor for accessing the rule base stored in memory, for identifying wheels requiring truing according to the rules in the rule base, and for making wheel truing recommendations according to the rules in the rule base.

27 Claims, 2 Drawing Sheets

RAIL WHEEL SERVICING MANAGEMENT

FIELD OF THE INVENTION

This invention relates generally to the field of rail transportation and, more particularly, to managing servicing of rail vehicle wheels.

BACKGROUND OF THE INVENTION

A typical train includes one or more locomotives pulling a plurality of load cars. Each vehicle in the train includes a plurality of steel wheels that roll along the metal rail as the train is propelled along the track. Proper interaction between the wheel and the rail is critical for safe, reliable, efficient operation of the train.

A rail includes a bottom mounting flange, a top railhead that makes contact with the rail vehicle wheel, and a flange interconnecting the flange and the railhead. A rail vehicle wheel includes a center hub mounted onto the vehicle axle, a plate extending outwardly from the hub, and an outer rim surrounding the plate for making contact with the rail. A rail vehicle wheel set includes two wheels connected by their respective hubs to opposite ends of an axle. The rim includes an outside diameter tread that may be flat or tapered and a flange extending outwardly from a back side of the tread. The tread rides along a top surface of the railhead for supporting the vertical weight of the vehicle. The flange extends along and makes contact with a side of the railhead for providing lateral support to allow the wheel to follow along the path of the railhead. Flanges are provided on only one side of each wheel along an inside of the rail.

Rail vehicle wheels suffer wear over time due to their contact with the rail. The treads wear as a result of their contact with the top of the rail, particularly in the event of the wheel slipping with respect to the rail during acceleration or braking events. The wheel flanges will wear due to their contact with the inside surface of the railhead, particularly on curves and through switches. Consequently, rail wheel wear must be monitored to ensure that dimensions of the wheel subject to wear are sufficient for continued safe use.

Rail wheel dimensions, such as rim thickness, flange thickness, flange height, and a rim diameter of a train wheel, are subject to Federal Railway Administration (FRA) and/or railroad dimension limits. Such dimension limits may be based on wheel set membership in a truck and/or in a rail vehicle, and whether or not an axle of the wheel set has been shimmed. When a wheel dimension wears to a value beyond a dimension limit, the wheel must be machined to an acceptable dimension and/or axle shims installed to bring the wheel back into compliance with the dimension requirements. If there is not enough material left on wheel to support further machining, or shims cannot be used to extend the life of a wheel set, the wheel set must be condemned. In addition, wheel dimensions must be checked with respect to dimensions of other wheels of the same truck and other wheels of other trucks of the rail vehicle to insure that dimension differences among the wheels do not exceed predetermined difference limits. For example, FRA wheel truing rules may require that there be no more than a 0.75 inch difference among rim diameters for wheels of a truck and no more than a 1.25 inch difference among rim diameters for all the wheels of a locomotive.

Furthermore, the presence of shims may change wheel dimension limit and wheel dimension difference limit requirements.

DETAILED DESCRIPTION OF THE INVENTION

Figure 1:
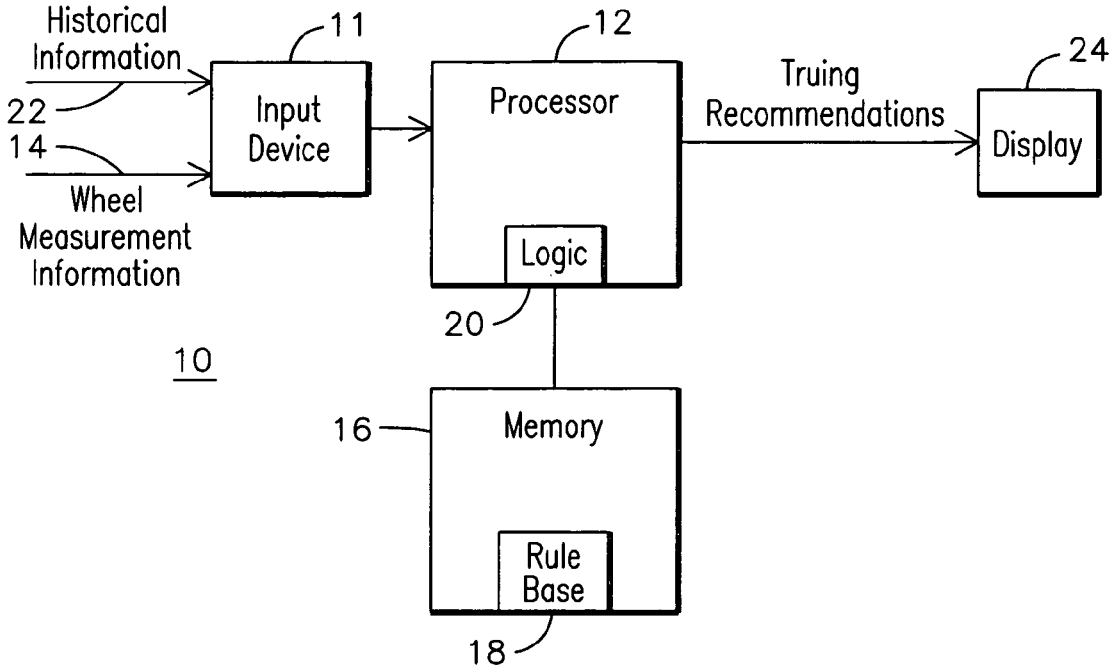
FIG. 1 shows a schematic diagram for an example system for automatically providing rail wheel truing recommendations based on rail wheel measurements and truing rules.

Typically, rail wheel servicing decisions are made by a maintenance personnel based on measured wheel dimensions recognized by the maintenance personnel as being out of specification. Based on the measured wheel dimensions and knowledge of wheel truing rules, the maintenance personnel then manually calculate wheel truing recommendations based on proposed truing activities and the resulting effective on allowable differences between the trued wheels and other wheels of the truck and/or locomotive. However, such manually derived truing recommendations tend to be error prone due to incorrect calculation or misinterpretation or misapplication of truing rules. Consequently, over-machining and/or too early condemnation of wheels may result, allowing useable wheel wear life to be sacrificed. An improved rail wheel service management method receives rail wheel measurement information and automatically applies rail wheel truing rules uses rail wheel measurement to provide maintenance personnel with a more accurate and consistent recommendations for truing wheels of a rail vehicle.

In an embodiment of the invention, a method for automatically providing rail wheel truing recommendations includes receiving measured rail wheel dimensions for wheels of a rail vehicle. For example, measured rail wheel dimensions may be provided by rail vehicle wheel maintenance personnel performing rail wheel measurements using a manual or electronic wheel gauge. The method may also include receiving wheel defect information based on wheel defects observed by the maintenance personnel. Defect information may include a type of defect, such as a flat and/or shell, and a dimension of the defect, such as depth of the defect. After receiving measurement information and/or defect information, the method may include automatically identifying ones of the wheels exceeding predetermined dimension limits for the wheels, for example, based on predetermined dimension limits, such as FRA designated limits. The method may then include automatically providing wheel truing recommendations for servicing the wheels of the rail vehicle to bring the identified ones of the wheels within the predetermined dimension limits. The method may further include providing truing recommendations for other wheels not being identified as exceeding dimension limits to maintain the wheels of the rail vehicle within predetermined dimension difference limits among the wheels. FRA rules for truing may be different depending on whether an axle of the wheel has been shimmed. Accordingly, a truing recommendation for a wheel may be suggested based on whether or not a shim is associated with the wheel being considered for truing.

Wheel truing recommendations may include machining of an identified wheel to bring the wheel into compliance with a dimension limits. In another aspect, a truing recommendation may include shimming an axle of the identified wheel, for example, if the wheel cannot be brought into compliance by machining. In another embodiment, a truing recommendation may be made based on historical truing activities, such as statistical average losses for wheels being trued. Such losses may be determined based on differences between an amount of machining that was needed to true certain wheels, and how much machining was actually performed on those wheels above what was needed. The method may further include automatically recognizing when a wheel cannot be trued without exceeding a dimension limit. For example, the method may include automatically recognizing when a wheel truing recommendation for a first dimension, such as a flange height, would exceed a limit for a second dimension of the wheel, such as a rim diameter. Such a situation may result in a combo drop recommendation, unless the trued wheel could still be used by adding shims.

As shown in FIG. 1, a system 10 for providing rail wheel truing recommendations based on rail wheel measurements may include a processor 12 receiving measured rail wheel dimension information 14 for respective wheels of a rail vehicle. In an aspect of the invention, measured rail wheel dimension information 14 may be provided in the form of measured values of wheel dimensions being input by maintenance personnel performing wheel measurements, or by downloading measurement information from an electronic measuring device, such as an electronic wheel gauge. The dimension information may be provided via an input device 11, such as a mouse or a keyboard for manual input, or a wired, wireless, or infrared signal interface for uploading information to the processor 12. The processor 12 may be in communication with a memory 16 storing a rule base 18 comprising rules for performing rail wheel truing. For example, the rule base 18 may include FRA and/or railroad specific predetermined dimension limits for rail wheels, such as predetermined dimensions limits for wheel rim thickness, wheel flange thickness, wheel flange height, and a wheel rim diameter. The rule base 18 may also include predetermined wheel dimension difference limits among wheels of a rail vehicle truck, and difference limits among wheels of a truck or trucks of a rail vehicle, such as a truck of trucks of a locomotive or rail car.

The processor 12 may include logic 20 executable by the processor 12 for accessing the rule base 18 stored in memory 16 and for identifying wheels requiring truing according to truing rules maintained in the rule base 18. For example, the logic 20 may be configured for comparing a measured wheel dimension corresponding to a wheel dimension limit maintained in the rule base 18 to determine if the measurement is within the limit. The logic 20 may be further configured for making wheel truing recommendations according to the rules in the rule base 18, such as making a machining recommendation to bring a wheel within a corresponding dimension limit. In another aspect, the logic 20 may be configured for making a shim recommendation, for example, if a rail wheel rim diameter cannot be brought back within a wheel diameter dimension limit by machining. In yet another aspect, the logic 20 may be configured for making wheel truing recommendations to maintain the wheels of the rail vehicle within predetermined dimension difference limits among the wheels. For example, based on proposed truing recommendation for wheels of a rail vehicle exceeding dimensions limits, the logic 20 may be configured to examine other wheels of the rail vehicle having dimensions within applicable limits to determine whether differences among the wheels as a result of the proposed truing may exceed dimension difference limits. If excessive dimension different limits are identified, then the logic 20 may be configured for making truing recommendation for the other wheels to ensure that the dimension differences among the wheels are within applicable limits. In yet another aspect, the logic 20 may be configured for making truing recommendations based on historical information 22 provided to the processor 12, such as past truing practices of a certain wheel truing facility. Wheel truing recommendations may be provided to a user via display 24.

Figure 2:
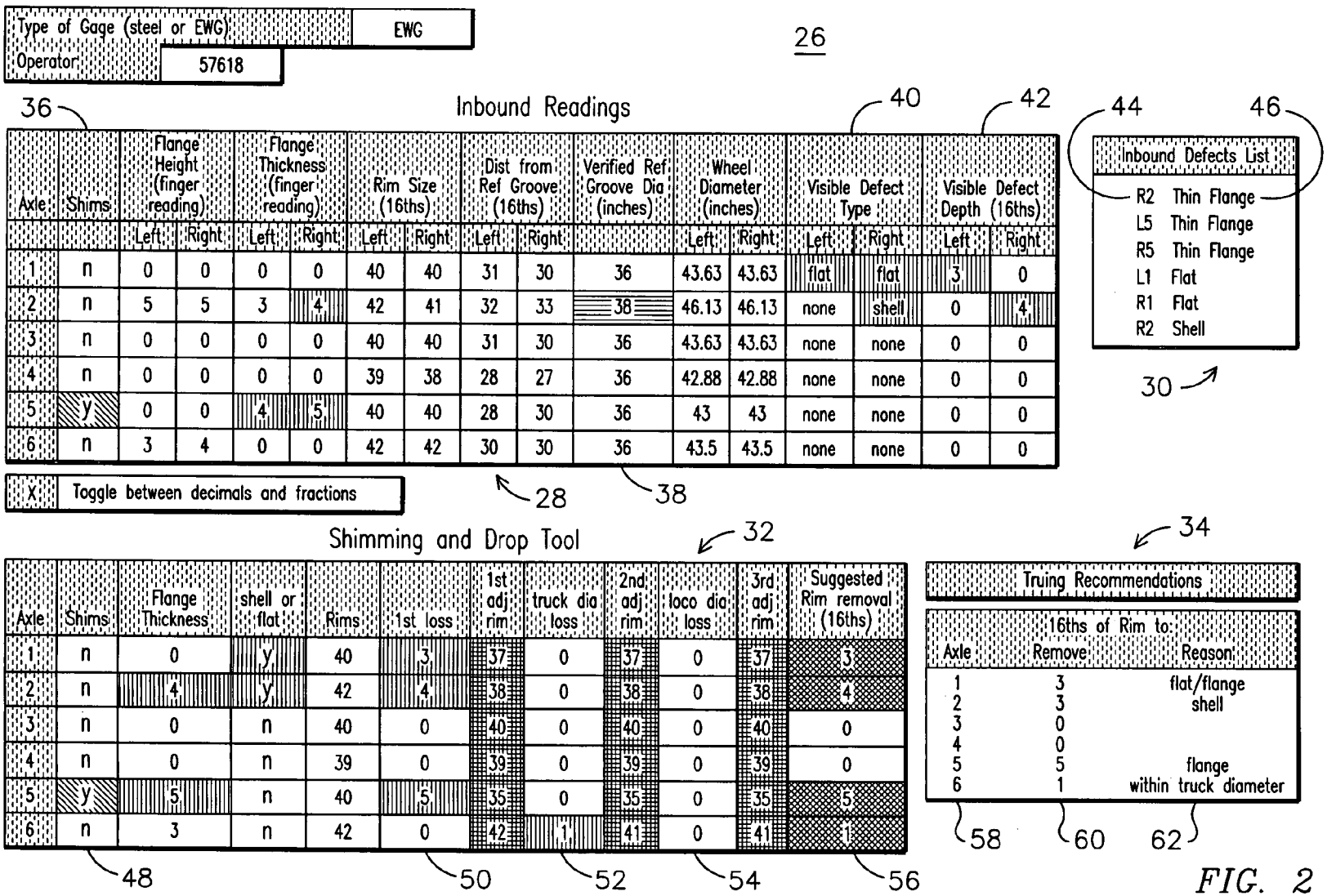
FIG. 2 shows an example graphical user interface (GUI) for providing rail wheel truing recommendations based on rail wheel measurements and truing rules.

FIG. 2 shows an example interactive graphical user interface (GUI) 26 for providing rail wheel truing recommendations based on rail wheel measurements and truing rules. The GUI 26 may include a wheel condition window 28 for displaying measured wheel dimensions and/or observed wheel defects for wheels of a rail vehicle, such as a locomotive or rail car. Measured wheel dimensions and observed wheel defects may be provided by a user inputting the information directly by using interactive elements of the GUI 26, or may be uploaded to the GUI 26 from another source, as an electronic wheel gauge.

In an aspect of the invention, the GUI 26 may be configured for identifying ones of the wheels being measure exceeding predetermined dimension limits for the wheels, such as FRA dimension limits. Accordingly, the GUI 26 may highlight the identified ones of the wheels, such as by using a different background color, to indicate which measured wheel may require truing. The wheel condition window 28 may also include a shim indication section 36 to indicate presence of shims for shimmed axles associated with the wheels. In an aspect of the invention, indicia indicative of axles having shims may be highlighted, to emphasize presence of shims. The wheel condition window 28 may also include a verified reference groove section 38 that may include highlighting of certain rim reference groove diameters that may, for example, be less commonly used. The wheel condition window 28 may further include a visible defect section 40 for inputting visible wheel defects and, optionally, type of defect. The wheel condition window 28 may further include a visible defect depth section 42 for inputting a depth of identified wheel defects. Wheels having defects and depths of the defects may be highlighted to emphasize their presence.

The GUI 26 may also include a wheel anomaly window 30 for displaying ones of the wheels of the rail vehicle being identified by the GUI 26 as having an anomaly. The wheel anomaly window may include a wheel identifier 44 and a brief description 46 of a type of wheel anomaly to allow a user to quickly identify wheels that may need truing.

The GUI 26 may also include a wheel truing window 32, for example, arranged by axle number of a rail vehicle being measured, for interactively displaying wheel truing recommendations for wheels of a rail vehicle, such as machining and/or shimming recommendations. For example, the wheel truing window 32 may be configured for providing truing recommendations for servicing the wheels of the rail vehicle to bring the identified ones of the wheels within predetermined dimension limits and to maintain the wheels of the rail vehicle within predetermined dimension difference limits among the wheels. In an embodiment, the wheel truing window 32 includes a shim selection section 48 for suggesting shims for certain axles to bring an associated wheel within dimension limits for continued use on the rail vehicle. The shim selection section 48 may also be configured for allowing a user to interactively select or deselect a shim to show a corresponding selection effect on a wheel truing recommendation, thereby allowing a user to interactively determine a truing scheme for wheels of the rail vehicle. The wheel truing window 32 may include sections showing a proposed first machining loss 50 to bring an identified wheel within dimension limits, a proposed second machining loss 52 to bring wheels of the trucks within dimension difference limits for the associated truck as a result of a proposed first loss machining, and a proposed third machining loss 54 to bring wheels of the rail vehicle within dimension difference limits for the rail vehicle as a result of a proposed second loss machining. The wheel truing window 32 may also include a section 56 showing recommended rim removal dimensions that may reflect a sum of the first, second, and third machining losses.

The GUI 26 may further include a truing recommendation window 34 for displaying wheel truing recommendation determined, for example, by the wheel truing window 32. The truing recommendation window 34 may include an axle number indication 58, a truing recommendation 60 for the axle, and a reason for truing 62. In an embodiment of the invention, the processor 12 of FIG. 1 may be configured to generate the GUI 26 for presentation on display 24.

Based on the foregoing specification, the methods described may be implemented using computer programming or engineering techniques including computer software, firmware, hardware or any combination or subset thereof, wherein the technical effect is to provide improved management of servicing rail vehicle wheels. Any such resulting program, having computer-readable code means, may be embodied or provided within one or more computer-readable media, thereby making a computer program product, i.e., an article of manufacture, according to the invention. For example, computer readable media may contain program instructions for a computer program code for measuring a rail wheel dimension and processing the measured wheel dimension relative to an allowable dimension. The computer readable media may also include a computer program code for predicting a remaining service life of the wheel based on a historical wear rate for the wheel being measured and the processed wheel dimension.

The computer readable media may be, for example, a fixed (hard) drive, diskette, optical disk, magnetic tape, semiconductor memory such as read-only memory (ROM), etc., or any transmitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will be able to combine the software created as described with appropriate general purpose or special purpose computer hardware, such as a microprocessor, to create a computer system or computer sub-system embodying the method of the invention. An apparatus for making, using or selling the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody the invention.

It will be understood that the specific embodiment of the invention shown and described herein is exemplary only. Numerous variations, changes, substitutions and equivalents will now occur to those skilled in the art without departing from the spirit and scope of the present invention. Accordingly, it is intended that all subject matter described herein and shown in the accompanying drawings be regarded as illustrative only and not in a limiting sense and that the scope of the invention be solely determined by the appended claims.

What is claimed is:

1. A system for providing rail wheel truing recommendations based on rail wheel measurements comprising:

an input device for receiving measured rail wheel dimensions for respective wheels of a rail vehicle;

a processor receiving the measured rail wheel dimensions from the input device;

a memory in communication with the processor for storing a rule base comprising rules for performing rail wheel truing;

logic executable by the processor for accessing the rule base stored in memory, for identifying wheels requiring truing according to the rules in the rule base and the measured rail wheel dimensions, and for making wheel truing recommendations according to the rules in the rule base; and a graphical user interface coupled to the processor, the graphical user interface comprising a wheel condition window for interactively displaying measured wheel dimensions and observed wheel defects for wheels of a rail vehicle and for automatically identifying ones of the wheels exceeding predetermined dimension limits for the wheels, the graphical user interface further comprising a wheel truing window for automatically determining wheel truing recommendations for servicing the wheels of the rail vehicle to bring the identified ones of the wheels within predetermined dimension limits and to maintain the wheels of the rail vehicle within predetermined dimension difference limits among the wheels and for interactively displaying the wheel truing recommendations, wherein the wheel truing window comprises an interactive shim selection section for allowing a user to select and deselect use of a shim and for displaying an effect on a wheel truing recommendation responsive to a shim selection to allow a user to interactively determine a truing scheme among wheels of the rail vehicle.

2. The system of claim 1, wherein the rules comprise predetermined dimension limits for the wheels.

3. The system of claim 1, wherein the rules comprise predetermined dimension limits for wheels of axles having shims.

4. The system of claim 1, wherein the rules comprise predetermined wheel dimension difference limits among wheels of a truck of the rail vehicle.

5. The system of claim 1, wherein the rules comprise predetermined wheel dimension difference limits among wheels of a truck of the rail vehicle wherein at least one axle of the truck includes shims.

6. The system of claim 1, wherein the rules comprise predetermined wheel dimension difference limits among wheels of a plurality of trucks of the rail vehicle.

7. The system of claim 1, further comprising a display for displaying wheel truing recommendations.

8. A method for automatically providing rail wheel truing recommendations based on rail wheel measurements comprising:

receiving measured rail wheel dimensions for wheels of a rail vehicle;

automatically identifying ones of the wheels exceeding predetermined dimension limits for the wheels;

automatically providing wheel truing recommendations for servicing the wheels of the rail vehicle to bring the identified ones of the wheels within the predetermined dimension limits and to maintain the wheels of the rail vehicle within predetermined dimension difference limits among the wheels;

interactively displaying measured wheel dimensions and observed wheel defects for wheels of a rail vehicle;

automatically identifying ones of the wheels exceeding predetermined dimension limits for the wheels;

automatically determining wheel truing recommendations for servicing the wheels of the rail vehicle to bring the identified ones of the wheels within predetermined dimension limits and to maintain the wheels of the rail vehicle within predetermined dimension difference limits among the wheels; and interactively displaying the wheel truing recommendations, including displaying an effect on a wheel truing recommendation responsive to a shim selection to allow a user to interactively determine a truing scheme among wheels of the rail vehicle, based on a user selecting and deselecting use of a shim.

9. The method of claim 8, further comprising providing a truing recommendation for a wheel responsive to a shim being associated with the wheel.

10. The method of claim 8, wherein providing wheel truing recommendations comprises providing a machining recommendation for a wheel.

11. The method of claim 8, wherein providing wheel truing recommendations comprises providing a shim recommendation for a wheel.

12. The method of claim 8, further comprising receiving a wheel defect type.

13. The method of claim 12, further comprising receiving a wheel defect depth.

14. The method of claim 8, wherein the predetermined limits are Federal Railroad Association railroad wheel dimension limits.

15. The method of claim 8, further comprising:

receiving historical wheel truing activities; and providing wheel truing recommendations based on the received historical data.

16. The method of claim 8, further comprising automatically recognizing when a wheel cannot be trued without exceeding a dimension limit.

17. The method of claim 8, further comprising automatically recognizing when performing a wheel servicing recommendation for a first dimension of the wheel would result in exceeding a limit for a second dimension of the wheel.

18. An interactive graphical user interface for automatically providing rail wheel truing recommendations based on rail wheel measurements of a rail vehicle, comprising:

a wheel condition window for interactively displaying measured wheel dimensions and observed wheel defects for wheels of a rail vehicle and for automatically identifying ones of the wheels exceeding predetermined dimension limits for the wheels; and a wheel truing window for automatically determining wheel truing recommendations for servicing the wheels of the rail vehicle to bring the identified ones of the wheels within predetermined dimension limits and to maintain the wheels of the rail vehicle within predetermined dimension difference limits among the wheels and for interactively displaying the wheel truing recommendations, wherein the wheel truing window further comprises an interactive shim selection section for allowing a user to select and deselect use of a shim and for displaying an effect on a wheel truing recommendation responsive to a shim selection to allow a user to interactively determine a truing scheme among wheels of the rail vehicle.

19. The graphical user interface of claim 18, further comprising a wheel anomaly window for displaying ones of the wheels of a rail vehicle being identified as exceeding predetermined dimension limits for the wheels.

20. The graphical user interface of claim 18, further comprising a truing recommendation window for displaying wheel machining recommendations.

21. The graphical user interface of claim 18, wherein the wheel condition window further comprises a verified reference groove section.

22. The graphical user interface of claim 18, wherein the wheel condition window further comprises a wheel defect input section.

23. The graphical user interface of claim 18, wherein the wheel condition window further comprises a wheel defect depth input section.

24. An interactive graphical user interface for automatically providing rail wheel truing recommendations based on rail wheel measurements of a rail vehicle, comprising:

a wheel condition window for interactively displaying measured wheel dimensions and observed wheel defects for wheels of a rail vehicle and for automatically identifying ones of the wheels exceeding predetermined dimension limits for the wheels; and a wheel truing window for automatically determining wheel truing recommendations for servicing the wheels of the rail vehicle to bring the identified ones of the wheels within predetermined dimension limits and to maintain the wheels of the rail vehicle within predetermined dimension difference limits among the wheels and for interactively displaying the wheel truing recommendations, wherein the wheel truing window further comprises a proposed first machining loss section identifying a machining loss to bring an identified wheel within dimension limits.

25. The graphical user interface of claim 24, wherein the wheel truing window further comprises a proposed second machining loss section to identify a machining loss to bring wheels of a truck within dimension difference limits for the truck as a result of a proposed first loss machining.

26. The graphical user interface of claim 25, wherein the wheel truing window further comprises a proposed third machining loss section identifying a machining loss to bring wheels of the rail vehicle within dimension difference limits for the rail vehicle as a result of a proposed second loss machining.

27. A system for providing rail wheel truing recommendations based on rail wheel measurements comprising:

an input device for receiving measured rail wheel dimensions for respective wheels of a rail vehicle;

a processor receiving the measured rail wheel dimensions from the input device;

a memory in communication with the processor for storing a rule base comprising rules for performing rail wheel truing;

logic executable by the processor for accessing the rule base stored in memory, for identifying wheels requiring truing according to the rules in the rule base and the measured rail wheel dimensions, and for making wheel truing recommendations according to the rules in the rule base; and a graphical user interface coupled to the processor, the graphical user interface comprising a wheel condition window for interactively displaying measured wheel dimensions and observed wheel defects for wheels of a rail vehicle and for automatically identifying ones of the wheels exceeding predetermined dimension limits for the wheels, the graphical user interface further comprising a wheel truing window for automatically determining wheel truing recommendations for servicing the wheels of the rail vehicle to bring the identified ones of the wheels within predetermined dimension limits and to maintain the wheels of the rail vehicle within predetermined dimension difference limits among the wheels and for interactively displaying the wheel truing recommendations, wherein the wheel truing window further comprises at least one of the following: a proposed first machining loss section identifying a machining loss to bring an identified wheel within dimension limits; a proposed second machining loss section to identify a machining loss to bring wheels of a truck within dimension difference limits for the truck as a result of a proposed first loss machining; and/or a proposed third machining loss section identifying a machining loss to bring wheels of the rail vehicle within dimension difference limits for the rail vehicle as a result of a proposed second loss machining.

* * * * *